US005636766A

United States Patent [19]

Delameter et al.

[11] Patent Number: 5,636,766

[45] Date of Patent: Jun. 10, 1997

[54] DUAL VESSEL BEVERAGE DISPENSER

[76] Inventors: Scott T. Delameter, 1484 Monrovia Ave., Newport Beach, Calif. 92663; Mike J. Hanley, 254 S. Flower #D, Orange, Calif. 92668

[21] Appl. No.: 285,338

[22] Filed: Aug. 2, 1994

[51] Int. Cl.[6] ..... B67D 5/06

[52] U.S. Cl. ..... 222/183; 222/325

[58] Field of Search ..... 222/131, 183, 222/185.1, 325, 509, 518

[56] References Cited

U.S. PATENT DOCUMENTS

| | | | |
|---|---|---|---|
| 2,274,409 | 2/1942 | Harbison | 222/183 |
| 3,191,810 | 6/1965 | Johnston | 222/183 |
| 3,212,681 | 10/1965 | Weikert | 222/183 |
| 3,228,568 | 1/1966 | Harr | 222/183 |
| 3,325,058 | 6/1967 | West, Jr. | 222/183 |
| 5,118,009 | 6/1992 | Novitsky | 222/183 |

FOREIGN PATENT DOCUMENTS

| | | | |
|---|---|---|---|
| 8900666 | 10/1990 | Netherlands | B65D 77/06 |
| 23744 | of 1912 | United Kingdom . | |

*Primary Examiner*—Philippe Derakshani
*Attorney, Agent, or Firm*—Gene Scott; Patent Law & Venture Group

[57] ABSTRACT

An apparatus is provided for storing and dispensing a beverage such as beer or wine. An outer insulated vessel encloses a replaceable inner vessel which holds the beverage. The inner vessel provides a valve controlled spout which is auto-positioned into engagement with a dispensing tube attached to the outer vessel when the vessels are in place. A hole in the outer vessel allows a handle to be brought into contact with the valve by external actuation so that the beverage enjoys the thermal protection of the outer vessel while being, itself, a light weight and easily replaced unit.

8 Claims, 3 Drawing Sheets

DUAL VESSEL BEVERAGE DISPENSER

FIELD OF THE INVENTION

This invention relates generally to beverage containers with a means for dispensing and more particularly to a dispensing apparatus having a stationary outer vessel and an removable inner vessel with a means for transferring a beverage from the inner to the outer vessel for dispensing.

BACKGROUND OF THE INVENTION

Invention and use in the subject area is well known. As for example Kiechles, U.K. 23,744 (October 1911) describes and teaches a dual vessel arrangement where the outer vessel is split horizontally so as to allow a dispensing tap fluidly engaged with the inner to protrude through the side wall of the outer vessel, but to fit tightly around the tap. In another example Weikert, U.S. Pat. No. 3,212,681 (October 1965) teaches the well known dual chamber dispenser most often used for milk. This apparatus uses a flexible tube which is threaded through a simple hole in the outer chamber and engaged with a weighted shutoff lever. This arrangement is simple, reliable and very clean. Harr, U.S. Pat. No. 3,228,568 (January 1966) discloses a counter-attachable beverage dispenser for soda fountain applications. This patent is most useful herein for its ingenious dispensing faucet, item 19 in FIG. 1. Finally, the Dutch patent, 8900666 (March 1989) teaches a means for supporting an inner container alternately at a height for dispensing or at a position where the apparatus is best able to be moved.

The prior art does not teach a means for engaging an inner rigid vessel and outlet tube with an outer insulating vessel and outlet tube whereby dispensing from the inner vessel may be controlled by a means from the outer vessel. The present invention fulfills this need and provides further related advantages.

SUMMARY OF THE INVENTION

The present invention teaches a dual vessel assembly having an outer vessel for containing an inner vessel in a thermally controlled state. The outer vessel provides a side wall and stand for holding the vessel at a level above a surface such as a table or counter. The side wall is preferably insulated and includes a dispensing tube and a dispensing handle. The inner vessel is designed to hold a beverage or other liquid such as milk, beer or wine. The inner vessel includes a dispensing tube controlled by a pushbutton valve. The side wall of the outer vessel includes a vertical channel for accepting the valve and dispensing tube of the inner vessel so that the inner vessel may be inserted into the outer vessel. With the inner vessel fully inserted into the outer vessel, the dispensing tubes of the inner and outer vessels are engaged and the push button is positioned at a clearance hole in the outer wall so that the dispensing handle can be used to actuate the valve thereby allowing the beverage to be dispensed through the tubes to a glass or other container. The invention fulfills the objective of providing a beverage container that is thermally insulated while providing a means for inserting a replaceable inner container into a rugged outer container while automatically engaging an inner and an outer spill tubes or spouts and enabling dispensing of a beverage from the inner vessel to be controlled by an external means.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
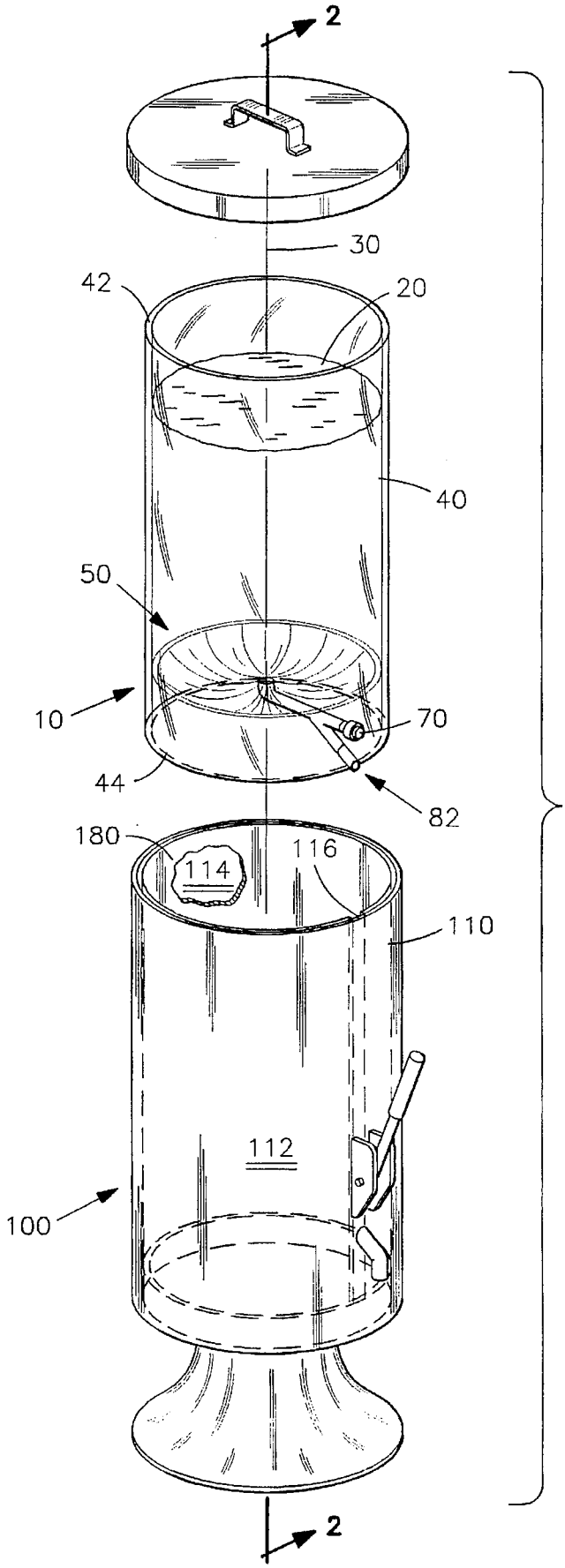
FIG. 1 is a perspective view of the invention showing an inner and an outer vessel of the invention and a top cover, each of these elements shown in exploded fashion for indicating the method of assembly; the interior insulating wall of the invention is shown partially removed to indicate the rigid wall behind.

FIG. 1 provides an overview of the present invention, a storage and dispensing apparatus for a liquid. A cylindrical inner vessel 10 is provided for storing the liquid 20. It has a vertically oriented longitudinal axis 30, and is preferably constructed with a side wall 40 terminating at a top 42 and a bottom 44 lips. The side wall 40 is preferably vertical, but could be cone shaped as well. The inner vessel has a bottom plate 50 which encloses the vessel 10 at a position near the bottom lip 44. The liquid 20 is held between the side wall 40 and the bottom plate 50. The bottom plate is preferably concave so as to be able to drain the last of the liquid 20 to a low point 52. At the low point 52 is positioned a drain hole 54 to which is attached a dispensing tube 60 for fluid communication with the liquid 20 in order to move it from the bottom plate 50 to the side wall 40. The tube 60 terminates at a dispensing valve 70 which extends through the side wall 40. The dispensing tube branches into a downwardly directed inner spill tube 80 which extends through the side wall 40 directly below the valve 70 and terminates at a spill orifice 82.

Figure 2:
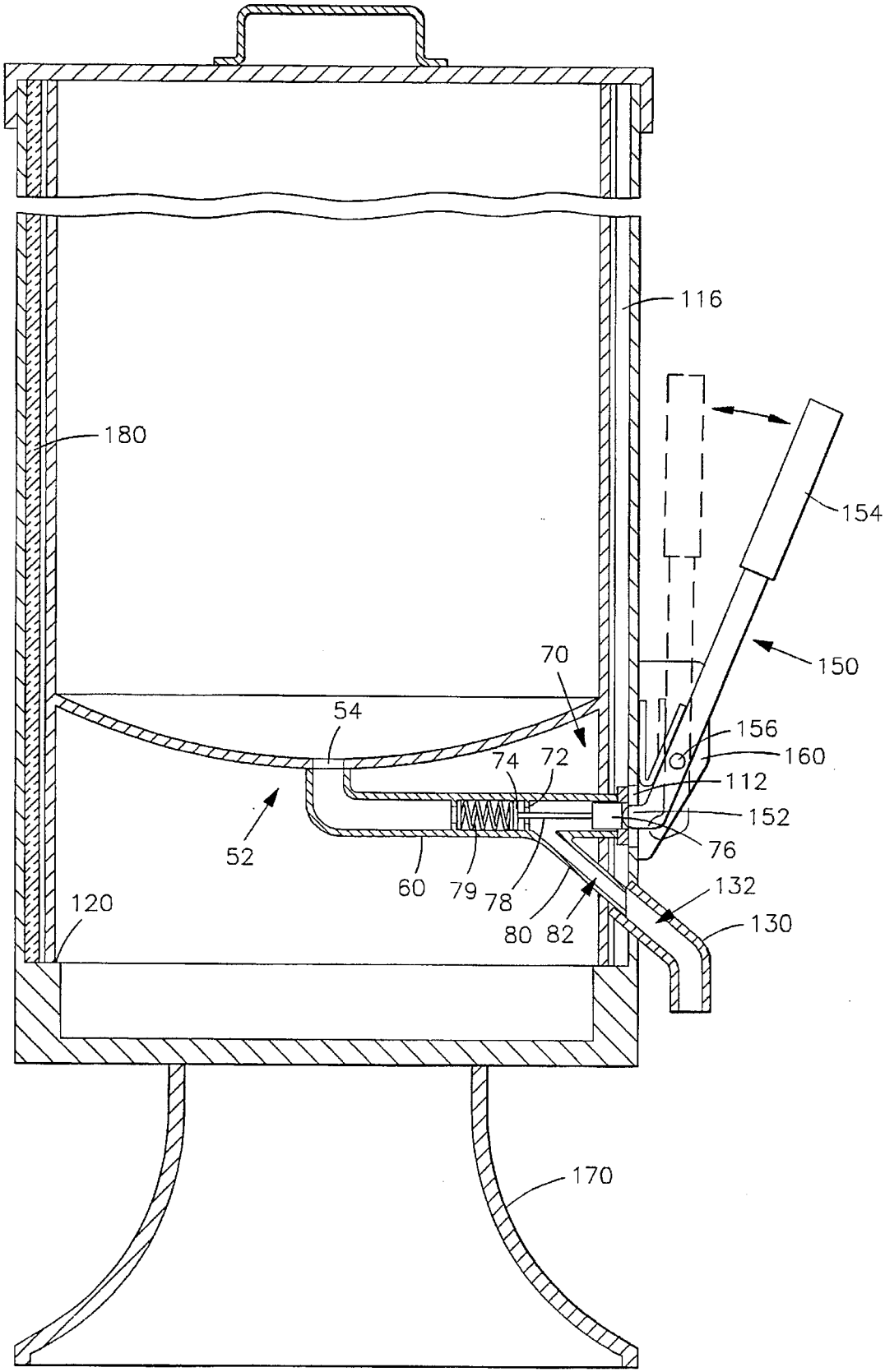
FIG. 2 is a side elevational view of the invention of FIG. 1 showing the various elements in place after assembly, and particularly showing details of the valve and actuation handle of the invention.

As best shown in FIG. 2, the valve 70 is preferably constructed with an inner annular lip 72 stoppered by a movable gasket 74 seated against the lip 72 so that the liquid cannot pass the lip 72. A valve push-button 76 has a push-rod 78 connected between the push-button 76 and the gasket 74 and is so oriented as to be externally accessible for actuation. When the push-button 76 is depressed, it forces the gasket 74 away from the annular lip 72 thereby allowing the liquid to pass from the dispensing tube 60 to the spill tube 80. A spring 79 is positioned to force the gasket 74 against the lip 72 when the push-button 76 is released, thereby causing the flow of liquid 20 to cease.

A cylindrical outer vessel 100 includes an outer side wall 110 having an out-facing surface 112 and an in-facing surface 114. The outer vessel 100 encloses the inner vessel 10 and provides an upfacing surface 120 for resting the bottom lip 44 of the inner vessel 10 upon. An outer spill tube 130 extends through the outer side wall 110 and projects in a downward direction for directing the liquid 20 into a receptacle such as a glass or a stein, etc. The outer spill tube 130 provides a receiving orifice 132 which is positioned so as to engage the spill orifice 82 of the inner spill tube 80, and also an access hole 112 positioned for accessing the push-button 76. The outer side wall 110 provides an interior vertical channel 116 for accepting passage of the dispensing valve 70 and the inner spill tube 80 during insertion of the inner vessel 10 into the outer vessel 100. The inner vessel 10 is positioned above the outer vessel 100 and with the inner spill tube 80 aligned with the channel 114, the inner vessel 10 is lowered into the outer vessel 100 until the inner spill tube 80 is engaged with the outer spill tube 130 and the lower lip 44 rests upon the up-facing surface 120. With the inner vessel 10 fully inserted, the push-button 76 is aligned with the hole 112.

The outer vessel 110 includes a means for actuating 150 the dispensing valve 70 to enable flow of the liquid 20 from the inner vessel 10, through the dispensing tube 60, to the inner spill tube 80 and therefrom, into the outer spill tube 130 for expulsion from the apparatus, generally into a glass or stein. The preferred actuating means 150 is a lever arm, as shown in FIG. 2, hingably engaged with, and vertically positioned on the outer vessel such as on the brackets 160. The lever arm has a lower terminal portion 152 positioned and adapted in shape, preferably convex, to press against the push-button 76 so as to enable a flow of the liquid 20 by pulling on an upper portion 154 of the lever arm in order to move the upper portion 154 away from the outer vessel 110 about a hinge pin 156 while, at the same time, pushing the lower portion 152 against the push-button 76.

The apparatus may include a means for supporting 170. Such a supporting means is preferably a stand as shown in the figures, or alternately could be a set of legs (not shown) or other means for positioning the outer vessel 110 on a surface such that the outer spill tube 130 is at a height for convenient filling of the receptacle. Such a supporting means 170 could be a wall hanging bracket, (not shown). A wall hanging bracket would allow the outer vessel 110 to be easily removed from the wall for cleaning.

Figure 3:
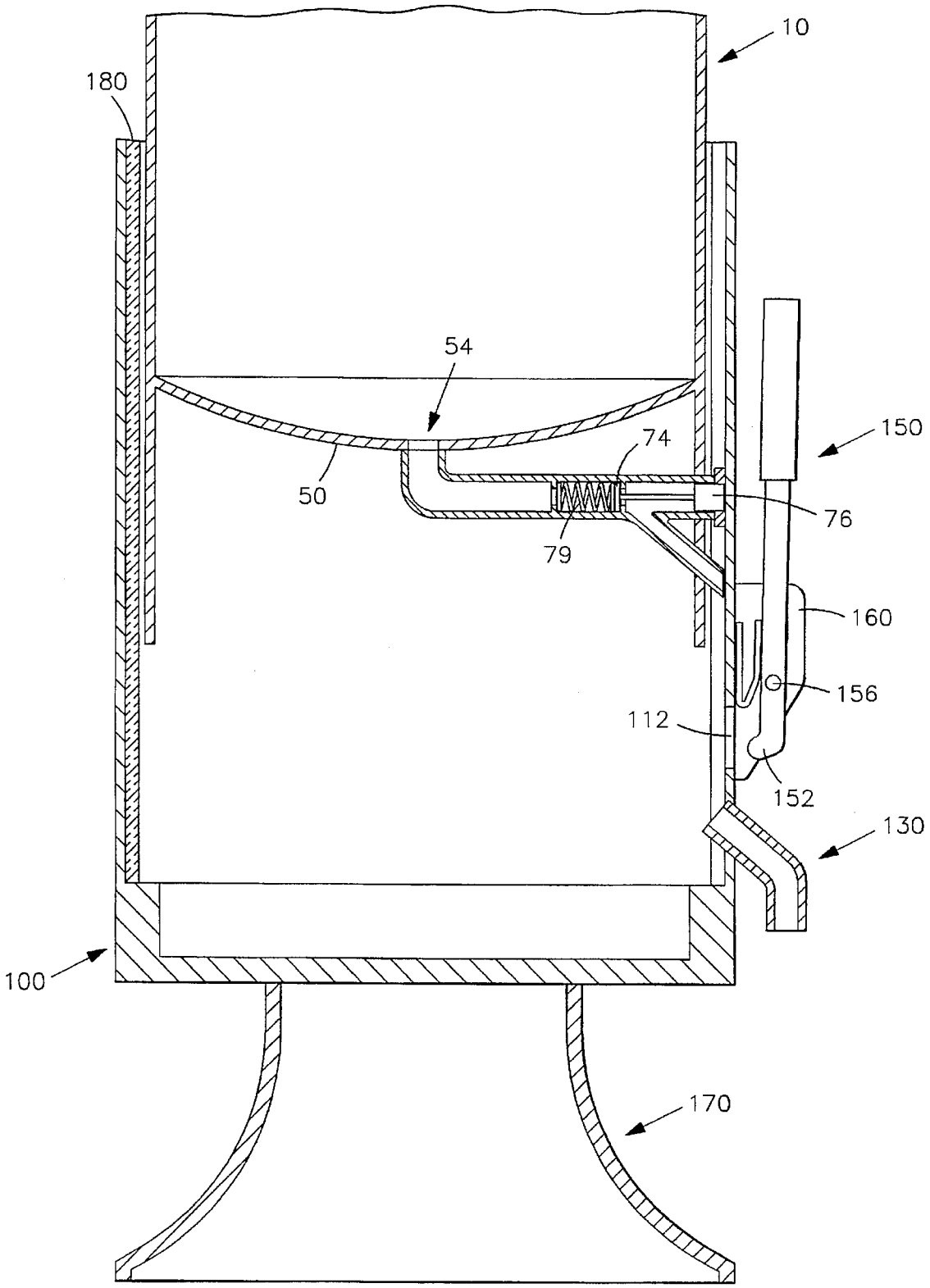
FIG. 3 is similar to FIG. 2 but showing the inner vessel being inserted into or withdrawn from the outer vessel of the invention.

The apparatus further preferably includes an insulating liner 180, as best shown in FIG. 3, wrapped in contact with the in-facing surface 114 of the outer side wall 110 to provide thermal insulation to the inner vessel 10. Thus the inner vessel 10 could contain a cold or hot beverage and maintain its temperature over an extended period of time.

The inner vessel 10 is preferably made of a transparent plastic material such as ABS, polycarbonate or acrylic plastic so that the liquid level in the vessel is visible from the side. While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A storage and dispensing apparatus for a liquid comprising:

a cylindrical inner vessel for storing the liquid, having a vertically oriented longitudinal axis, a side wall terminating at a top and a bottom lip, and a bottom plate enclosing the vessel at a position near the bottom lip, the liquid being held between the side wall and the bottom plate of the vessel, and including a dispensing tube in fluid communication with the liquid for moving same from the bottom plate to the side wall, the tube terminating at a dispensing valve extending through the side wall, the dispensing tube including a downwardly directed inner spill tube extending through the side wall below the valve and terminating in a spill orifice;

a cylindrical outer vessel providing an outer side wall having an out-facing surface and an in-facing surface, the outer vessel enclosing the inner vessel and providing an upfacing surface for resting the bottom lip of the inner vessel upon, an outer spill tube extending from the outer vessel and projecting therefrom in a downward direction for directing the liquid into a receptacle, the outer spill tube providing a receiving orifice positioned so as to engage the spill orifice of the inner spill tube, and an access hole positioned for accessing the dispensing valve therethrough, the outer side wall providing an interior vertical channel for accepting passage of the dispensing valve and the inner spill tube during insertion of the inner vessel into the outer vessel, such that with the bottom lip resting upon the upfacing surface, the inner spill tube is engaged within the outer spill tube and the dispensing valve is positioned coincident with the access hole;

the outer vessel further including a means for actuating the dispensing valve to enable flow of the liquid from the inner vessel, through the dispensing tube, to the inner spill tube and therefrom, into the outer spill tube for expulsion from the apparatus.

2. The apparatus of claim 1 wherein the means for actuating the dispensing valve is a lever arm hingably engaged with, and vertically positioned on the outer vessel, the lever arm having a lower terminal portion positioned and adapted in shape to press against the dispensing valve so as to enable a flow of the liquid by pulling on an upper portion of the lever arm to move said upper portion away from the outer vessel.

3. The apparatus of claim 2 further including a means for supporting the outer vessel on a surface such that the outer spill tube is at a height for filling the receptacle.

4. The apparatus of claim 1 further including an insulating liner wrapped in contact with the in-facing surface of the outer side wall to provide thermal insulation to the inner vessel.

5. The apparatus of claim 1 wherein the inner vessel is made of a transparent plastic material.

6. A storage and dispensing apparatus for a liquid comprising:

an inner vessel for storing the liquid, having a vertically oriented longitudinal axis, at least one side wall, and a bottom plate, the liquid being held between the side wall and the bottom plate of the vessel, and including a dispensing tube in fluid communication with the liquid, the tube terminating at a dispensing valve extending through the side wall, the dispensing tube including a downwardly directed inner spill tube terminating in a spill orifice;

an outer vessel providing at least one outer side wall, the outer vessel fully enclosing the inner vessel, an outer spill tube extending from the outer vessel and projecting therefrom in a downward direction for directing the liquid into a receptacle, the outer spill tube providing a receiving orifice positioned so as to engage the spill orifice of the inner spill tube when the inner vessel is enclosed within the outer vessel, and an access hole in the outer side wall, positioned for accessing the dispensing valve therethrough;

the outer vessel further including a means for actuating the dispensing valve to enable flow of the liquid from the inner vessel, through the dispensing tube, to the inner spill tube and therefrom, into the outer spill tube for expulsion from the apparatus.

7. The apparatus of claim 6 further including a means for supporting the outer vessel on a surface such that the outer spill tube is at a height for filling the receptacle.

8. The apparatus of claim 6 further including an insulating liner wrapped in contact with the outer side wall to provide thermal insulation to the inner vessel.

* * * * *